US006307580B1

(12) United States Patent
Yoshikawa

(10) Patent No.: US 6,307,580 B1
(45) Date of Patent: Oct. 23, 2001

(54) THERMAL PRINTHEAD AND METHOD OF MAKING THE SAME

(75) Inventor: Yasuhiro Yoshikawa, Kyoto (JP)

(73) Assignee: : Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/665,701

(22) Filed: Sep. 20, 2000

(30) Foreign Application Priority Data

Sep. 21, 1999 (JP) ..... 11-266453

(51) Int. Cl.[7] ..... B41J 2/335
(52) U.S. Cl. ..... 347/200
(58) Field of Search ..... 347/200

(56) References Cited

U.S. PATENT DOCUMENTS 5,739,837 4/1998 Nagahata et al. ..... 347/200

FOREIGN PATENT DOCUMENTS 5-147247 * 6/1993 (JP) .
11-216893 * 8/1999 (JP) .

* cited by examiner

*Primary Examiner*—Huan Tran
(74) *Attorney, Agent, or Firm*—Michael D. Bednarek; Shaw Pittman LLP

(57) ABSTRACT

A method of making a thermal printhead including a primary substrate and an auxiliary substrate adjacent to the primary substrate. The method comprises the following steps. First, at least one positioning cutout is formed in either one or both of the primary and auxiliary substrates. The positioning cutout is formed at an edge of the selected substrate. Then, the primary and auxiliary substrates are positioned to each other by using a position-adjusting device provided with an upright pin fitted into the positioning cutout. Then, the electrical connection is established between the first and the second substrates via clip pins.

12 Claims, 12 Drawing Sheets

THERMAL PRINTHEAD AND METHOD OF MAKING THE SAME

BACKGROUND OF THE INVENTION

1. Field of the invention

The present invention relates to a thermal printhead and also a method of making the same.

2. Description of the Related Art

As is well known, a thermal printhead is provided with an elongated heating resistor divided into a multiplicity of heating dots. In operation, the heating dots are selectively energized, so that heat is selectively supplied to transfer ink ribbon or thermosensitive paper for printing required images on recording medium.

Referring to FIG. 11 of the accompanying drawings which shows a related art (not prior art), a thermal printhead may include a heating resistor unit 31A, a signal relay unit 34A and a heat sink 38 supporting these two units. The heating resistor unit 31A includes a primary substrate 31 which is provided with a heating resistor 32 extending longitudinally of the substrate 31. A plurality of drive ICs 33 are mounted on the substrate 31 for controlling the operation of the heating resistor 32 based on externally supplied print data. Though not illustrated, a wiring pattern is formed on the substrate 31 for connecting the drive ICs 33 to the heating resistor 32.

The signal relay unit 34A includes an auxiliary substrate 34 formed with a predetermined wiring pattern (not shown). This non-illustrated wiring pattern is connected to terminal pads 36 formed on the obverse surface of the substrate 34. The terminal pads 36 are spaced from each other in the longitudinal direction of the substrate 34. A connector 37 is attached to the reverse surface of the substrate 34 for making electrical connection between the non-illustrated wiring pattern and an external device or circuit (not shown).

The illustrated thermal printhead also includes a plurality of conductive clip pins 35 for electrically connecting the heating resistor unit 31A to the signal relay unit 34A. Each pin 35 is formed with a generally U-shaped portion and a straight lead portion integral with the U-shaped portion. The U-shaped portion is clipped onto a connection terminal (not shown) formed on the primary substrate 31, while the lead portion is soldered to the relevant one of the terminal pads 36 corresponding to the non-illustrated connection terminal on the substrate 31.

The thermal printhead having the above arrangement is fabricated in the following manner. First, the heating resistor unit 31A and the signal relay unit 34A are prepared. At this stage, the clip pins 35 are attached to the primary substrate 31 of the heating resistor unit 31A but not connected to the signal relay unit 34A yet.

Then, as shown in FIG. 12, the signal relay unit 34A is mounted onto a first chuck member 41. Thereafter, the heating resistor unit 31A is mounted onto a second chuck member 42. The first chuck member 41 may be stationary, while the second chuck member 42 may be movable in sliding engagement with the first chuck member 41 in the directions shown by the double head arrow A in the figure.

For positioning the heating resistor unit 31A to the second chuck member 42, a plurality of upright pins 43 are provided on the second chuck member 42. In use, the substrate 31 of the unit 31A is brought into engagement with the respective pins 33, as shown in FIG. 12. The first chuck member 41, on the other hand, is provided with a positioning piece 46 having an L-shaped cross section, as shown in FIG. 13. (The positioning piece 46 is omitted in FIG. 12 for convenience of illustration.) The positioning piece 46 includes an upright contact surface 46*a*, which is brought into engagement with a contact edge 34*a* of the auxiliary substrate 34. With such an arrangement, the signal relay unit 34A is positioned relative to the first chuck member 41.

After the signal relay unit 34A and the heating resistor unit 31A are positioned on the first chuck member 41 and the second chuck member 42, respectively, the second chuck member 42 is moved relative to the first chuck member 41 as shown by the above-mentioned arrow A. In this manner, the lead portion of each clip pin 35 can be aligned with a relevant one of the terminal pads 36 of the signal relay unit 34A. Then, the lead portion of the clip pin 35 is soldered to the terminal pad 36.

Finally, the two units 31A, 34A are removed from the chuck members to be mounted on the heat sink 38 (FIG. 11). At this stage, the connector 37 is attached to the auxiliary substrate 34.

The use of the positioning piece 46 (FIG. 13) may suffer from the following drawback.

Specifically, for improving the production efficiency, the substrate 34 and many other identical substrates may be collectively obtained by cutting a large mother board into small pieces. In this case, the contact edge 34*a* of the resulting substrate 34 (and the other three edges as well) may often be formed with burrs due to the cutting operation. As readily understood, such burrs will prevent the substrate 34 from coming into proper contact with the contact surface 46*a* of the positioning piece 46. This means that the substrate 34 will fail to be positioned accurately relative to the first chuck member 41, which may result in inaccurate positioning of the clip pins 35 to the terminal pads 36 on the substrate 34.

Instead of using the illustrated positioning piece 46, at least two positioning holes 50 may be formed in the auxiliary substrate 34, as shown in FIG. 14, by drilling for example. In this case, the first chuck member 41 may be provided with upright protrusions to be fitted into the positioning holes 50. With such an arrangement, the auxiliary substrate 34 can be properly positioned on the first chuck member 41 since fewer burrs are formed on the surface of the drilled positioning holes 50 as compared to the contact edge 34*a*.

However, as shown in FIG. 14, the positioning holes 50 are formed in the wiring pattern-forming region S of the substrate 34. With such an arrangement, the room for providing the wiring pattern is disadvantageously restricted since the wiring pattern should avoid the location of the positioning holes 50.

SUMMARY OF THE INVENTION

The present invention has been proposed under the circumstances described above, and its object is to provide a method of making a thermal printhead, whereby the positioning of the heating resistor unit to the signal relay unit can be performed accurately.

According to a first aspect of the present invention, there is provided a method of making a thermal printhead including first and second substrates spaced from each other, the first substrate being provided with a heating resistor. The method comprises the steps of: forming at least one positioning cutout in at least one of the first and the second substrates; positioning the first and the second substrates relative to each other; and establishing electrical connection between the first and the second substrates. The positioning cutout is to be formed at an edge of said one of the first and the second substrates.

Preferably, the positioning cutout may comprise a semi-cylindrical groove. Instead, the positioning cutout may have a triangular or rectangular cross section.

For facilitating the positioning of the substrates, said one of the first and the second substrates may be formed with two positioning cutouts each of which is arranged at an edge of said one of the first and the second substrates.

Preferably, said one of the first and the second substrates may be provided with two longer edges and two shorter edges, in which the two positioning cutouts may be arranged at the shorter edges.

Preferably, the positioning cutout may be formed in the second substrate.

The method of the present invention may further comprise the step of mounting said one of the first and the second substrates onto a position adjusting chuck member provided with a positioning pin to be fitted into the positioning cutout.

Preferably, the electrical connection between the first and the second substrates may be established via linear conductive members bridging between the two substrates.

According to a second aspect of the present invention, there is provided a thermal printhead comprising: a first substrate provided with a heating resistor; a second substrate associated with the first substrate; and connecting means bridging between the first and the second substrates, wherein at least one positioning cutout is formed at an edge of at least one of the first and the second substrates.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
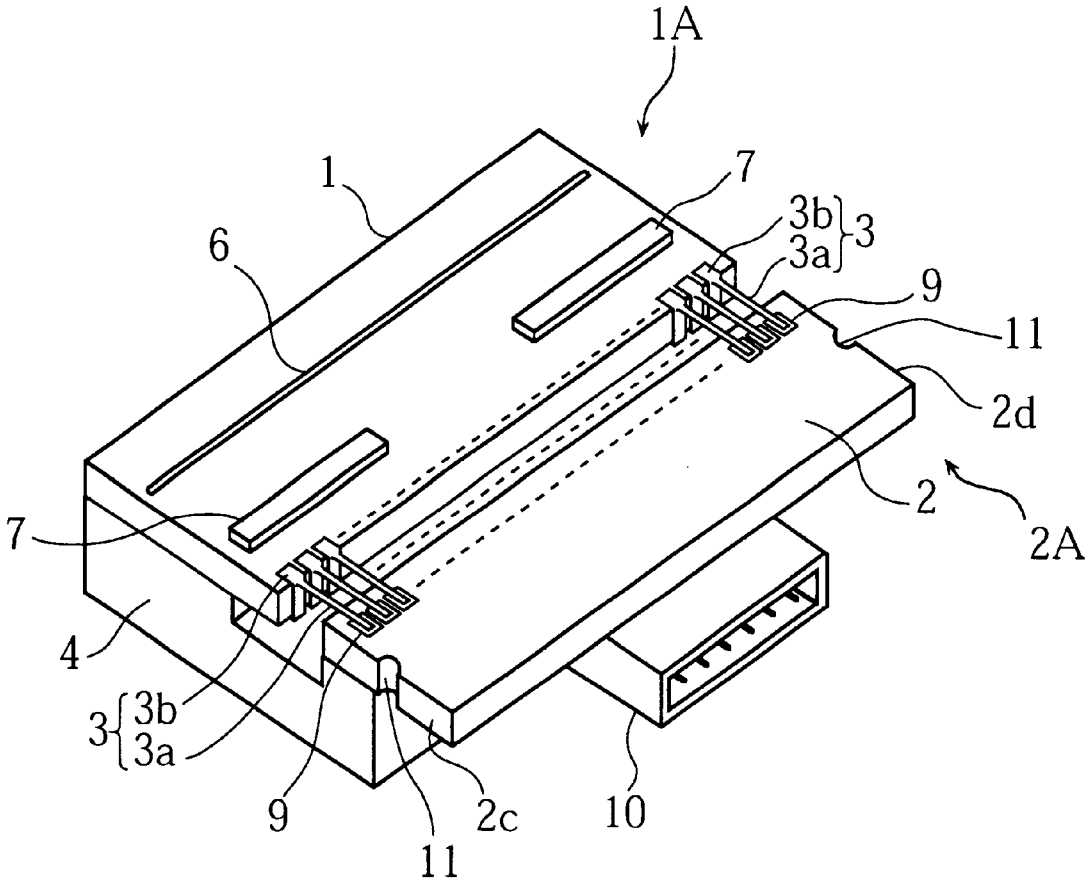
FIG. 1 is a perspective view showing a thermal printhead according to the present invention.
Figure 2:
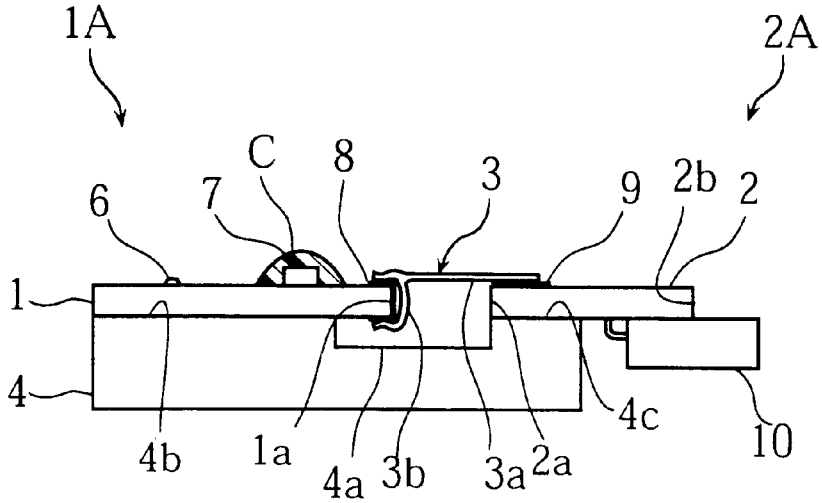
FIG. 2 is a side view showing the same thermal printhead.
Figure 3:
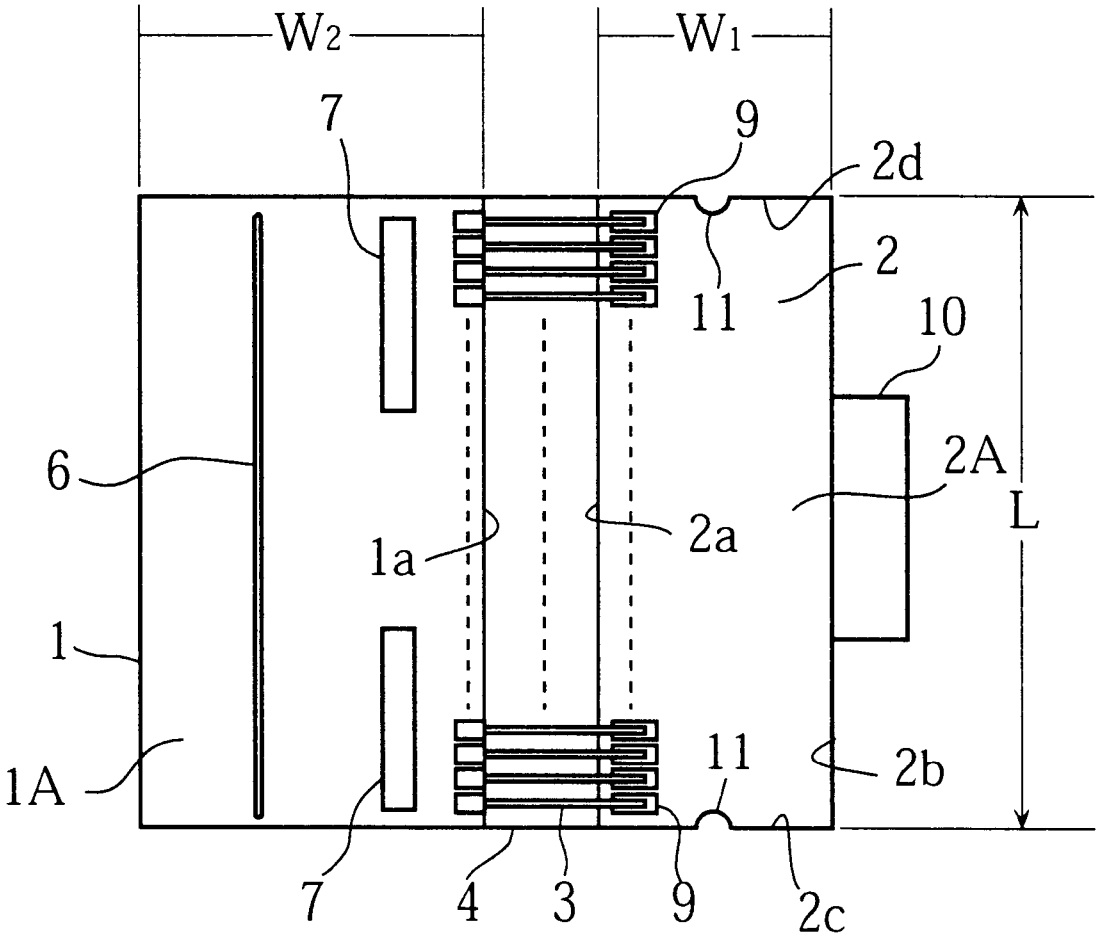
FIG. 3 is a plan view showing the same thermal printhead.

Reference is first made to FIGS. 1–3 showing a thermal printhead embodying the present invention. The illustrated printhead is provided with a heating resistor unit 1A and a signal relay unit 2A which is connected to the heating resistor unit 1A via a plurality of clip pins 3.

The heating resistor unit 1A includes an insulating substrate 1, an elongated heating resistor 6 and drive ICs 7. The heating resistor 6 and the drive ICs 7 are arranged on the obverse surface of the substrate 1. The substrate 1 is made of an insulating material such as alumina ceramic, and has a generally rectangular configuration.

The heating resistor 6 is divided into a multiplicity of small sections or "heating dots", as well known in the art. The heating dots are selectively heated up under the control of the drive ICs 7. As shown in FIG. 2, the drive ICs 7 are enclosed by a hard resin coating (C) formed on the substrate 1.

A predetermined wiring pattern (not shown) is formed on the substrate 1 for connecting the drive ICs 7 to the heating resistor 6. A plurality of connection terminals 8 (only one is shown in FIG. 2) are formed at a longitudinal edge 1*a* of the substrate 1. The connection terminals 8 are arranged at predetermined intervals along the edge 1*a*. Each of the connection terminals 8 is connected to a relevant one of the drive ICs 7.

The signal relay unit 2A includes an insulating substrate 2 which may be made of GFR (glass fiber reinforced) epoxy resin and has a generally rectangular configuration. As shown in FIG. 3, the length L of the substrate 2 (called "auxiliary substrate" below) is substantially equal to that of the substrate 1 (called "primary substrate"). The width W1 of the auxiliary substrate 2 is smaller than the width W2 of the primary substrate 1.

The signal relay unit 2A also includes a plurality of terminal pads 9 formed on the obverse surface of the auxiliary substrate 2. The terminal pads 9 are arranged at predetermined intervals along a longitudinal edge 2*a* of the substrate 2. The signal relay unit 2A further includes a connector 10 attached to the reverse surface of the auxiliary substrate 2. As shown in FIG. 2, the connector 10 protrudes beyond another longitudinal edge 2*b* of substrate 2.

A wiring pattern (not shown) is formed on the auxiliary substrate 2 for connecting the connector 10 to the terminal pads 9. A flexible cable (not shown) may be inserted into the connector 10 for establishing the electrical connection between the thermal printhead and an external device or circuit (not shown).

According to the present invention, the auxiliary substrate 2 is formed, at its shorter edges 2*c* and 2*d*, with grooves 11 extending through the thickness of the substrate 2. The grooves 11 are used for performing accurate positioning of the substrate 2 relative to a movable member, as will be described later. It should be appreciated here that the grooves 11 are disposed at the edges 2*c* and 2*d* of the substrate 2, and therefore do not interfere with the wiring pattern-forming portion of the substrate 2.

The heating resistor unit 1A and the signal relay unit 2A described above are mounted on a heat sink 4, so that unfavorable heat generated at these units will be dissipated through the heat sink 4. The heat sink 4 has a generally rectangular configuration and is substantially equal in length to the primary substrate 1 or auxiliary substrate 2 (see FIG. 3). The heat sink 4 is formed with a groove 4*a* (FIG. 2) extending in its upper surface, and this groove divides the upper surface of the heat sink 4 into two parts: a broader first portion 4*b* and a narrower second portion 4*c*. The first portion 4*b* is attached to the reverse surface of the primary substrate 1, while the second portion 4*c* is attached to the reverse surface of the auxiliary substrate 2. As best shown in FIG. 3, the primary substrate 1 is horizontally offset from the auxiliary substrate 1. For securing the heat sink 4 to the primary and auxiliary substrates 1 and 2, use may be made of an adhesive such as glue or double-sided tape.

As stated above, the electrical connection between the heating resistor unit 1A and the signal relay unit 2A is established by the clip pins 3. Each of the clip pins 3 may be made of phosphor bronze and is arranged to connect one terminal 8 on the substrate 1 to a relevant one of the terminal pads 9 on the substrate 2.

More specifically, as shown in FIG. 2, each clip pin 3 is provided with a linear lead portion 3*a* and a clip portion 3*b* integral with the lead portion 3*a*. The elastic clip portion 3*b*, having a generally C-shaped configuration, is clipped onto the connection terminal 8 on the primary substrate 1. In the clipping state, the clip portion 3*b* is held in close contact with the connection terminal 8. Thus, the clip portion 3*b* is properly connected to the terminal 8. The lead portion 3*b*, on the other hand, is soldered to the relevant one of the terminal pads 9 on the auxiliary substrate 2. Thus, the paired connection terminal 8 and terminal pad 9 are electrically connected to each other. Though not illustrated, the clip portion 3*b* and the relevant connection terminal 8 are enclosed by a resin material, whereby the clip pin 3 is secured to the primary substrate 1.

With the arrangement described above, external electric signals supplied to the connector 10 are sent to the primary substrate 1 via the non-illustrated wiring pattern of the auxiliary substrate 2 and the clip pins 3. Based on the thus supplied signals, the drive ICs 7 of the heating resistor unit 1A are caused to supply electric currents selectively to the heating dots in the heating resistor 6. Consequently, the selected heating dots are heated, whereby an desired image is formed on e.g. thermosensitive paper coming into contact with the heating resistor 6.

According to the present invention, the alignment of the heating resistor unit 1A with the signal relay unit 2A (except for the connector 10) may be performed in the following manner.

Figure 4:
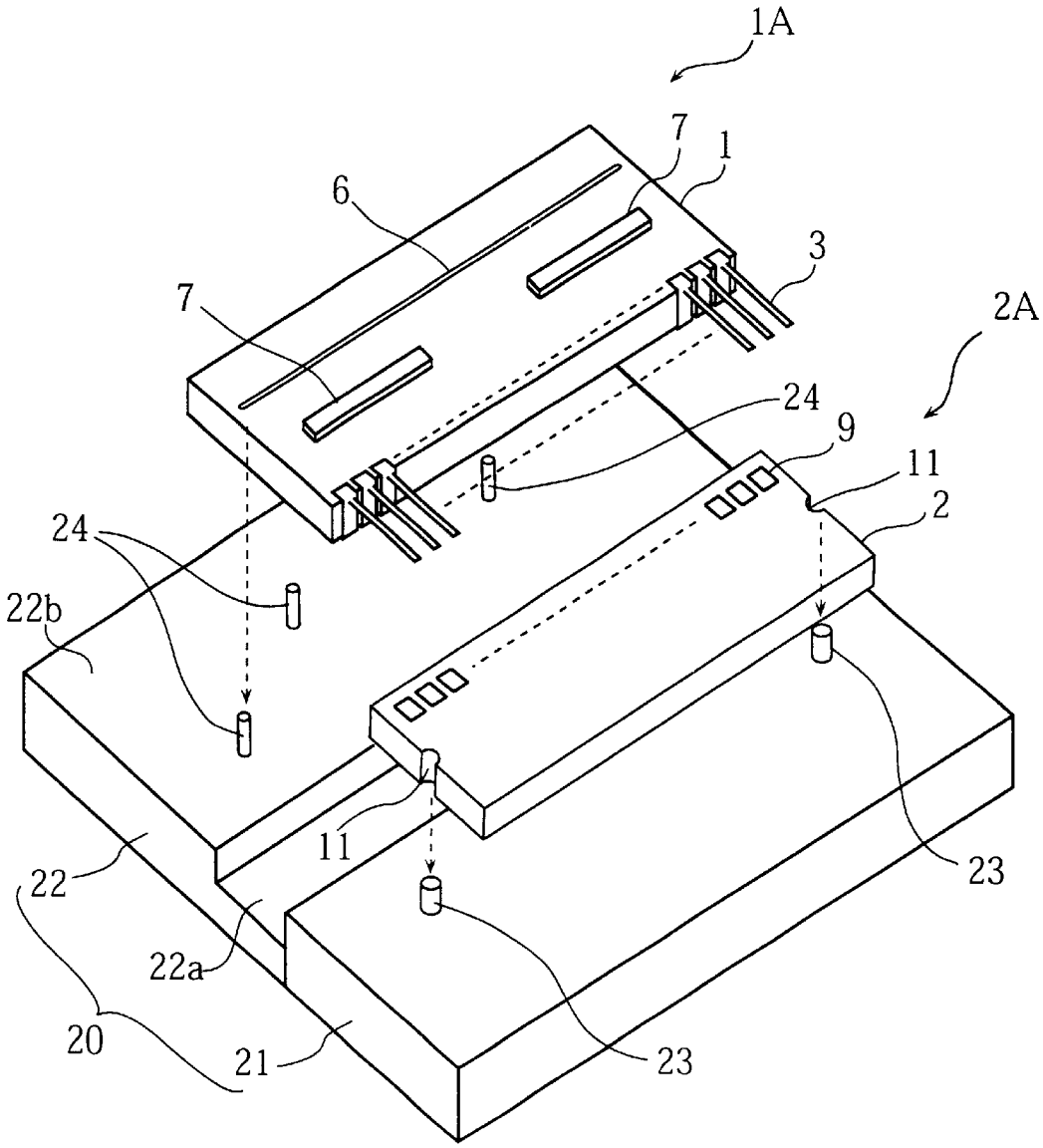
FIGS. 4 and 5 illustrate how the heating resistor unit of the above thermal printhead is aligned with the signal relay unit.

Specifically, referring to FIG. 4, the alignment of the two units 1A, 2A may be performed with the use of a chuck device 20 consisting of a first chuck member 21 and a second chuck member 22.

The first chuck member 21 has a rectangular configuration, and is provided with a sufficiently large upper surface for supporting the signal relay unit 2A. The first chuck member 21 is provided with two positioning pins 23 extending upright from the upper surface of the first chuck member. The positioning pins 23 are spaced from each other by a predetermined distance corresponding to the distance between the two grooves 11 formed on the substrate 2 of the unit 2A.

The second chuck member 22 has a generally rectangular configuration, and is provided with a step portion 22*a* on the upper side. The upper surface 22*b* of the second chuck member 22 is sufficiently large for supporting the heating resistor unit 1A. The second chuck member 22 is provided with three positioning pins or stoppers 24 extending upright from the upper surface 22*b*. The stoppers 24 are arranged at predetermined locations for positioning the heating resistor unit 1A relative to the second chuck member 22.

For performing the alignment of the two units 1A and 2A, the signal relay unit 2A is mounted onto the first chuck member 21 before the heating resistor unit 1A is mounted onto the second chuck member 22. As shown in FIG. 4, each of the positioning pins 23 is fitted into the relevant one of the grooves 11 of the substrate 2 in mounting the unit 2A on the first chuck member 21. The distance between the two positioning pins 23 is determined so that each pin 23 comes into contact with the concave surface of the relevant groove 11. With such an arrangement, the signal relay unit 2A is properly positioned relative to the first chuck member 21.

After the mounting of the unit 2A onto the first chuck member 21 has been completed, the heating resistor unit 1A is mounted onto the second chuck member 22. The positioning of the unit 1A relative to the second chuck member 22 is performed by bringing the primary substrate 1 of the unit 1A into simultaneous engagement with the three stoppers 24.

Figure 5:
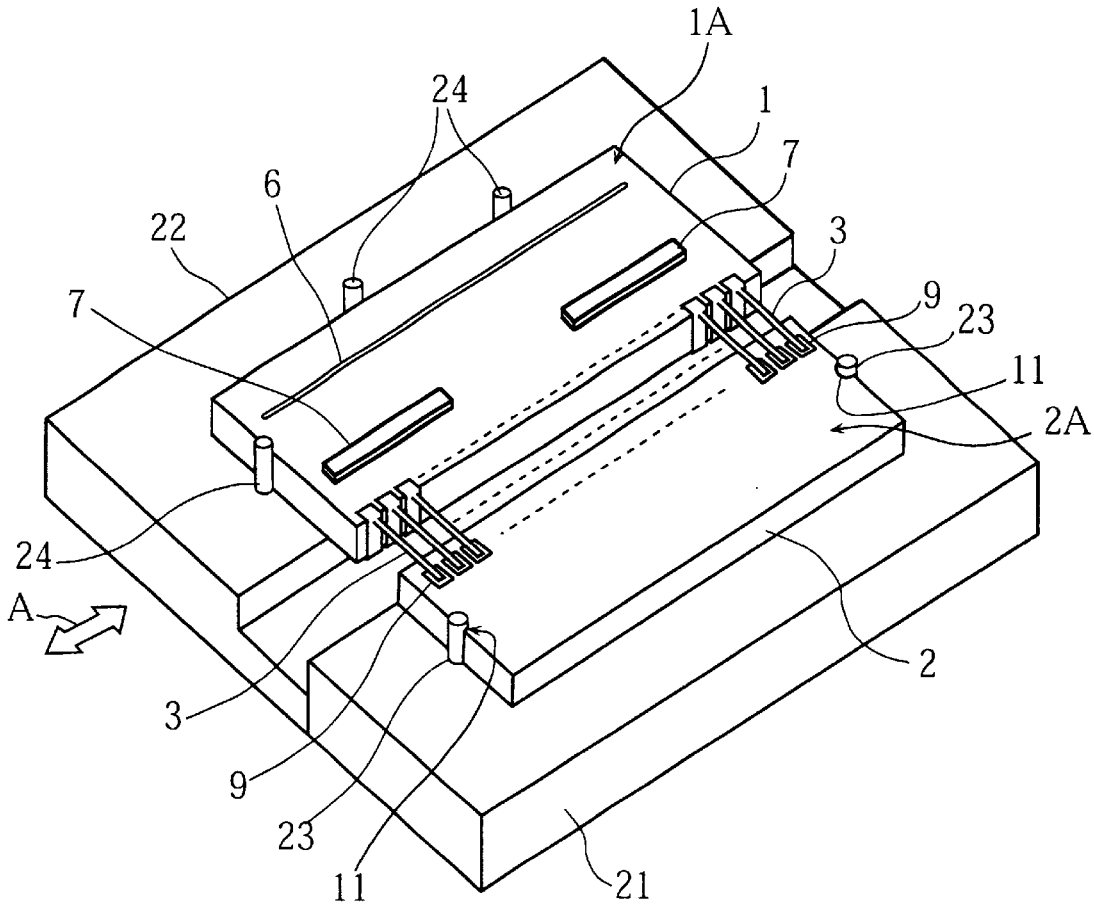

Then, referring to FIG. 5, the second chuck member 22 is moved, as shown by the double head arrow A, relative to the first chuck member 21 in sliding contact therewith. When the respective clip pins 3 are aligned with the relevant terminal pads 9 (one pin for one pad), the movement of the second chuck member 22 is stopped. In this state, the clip pins 3 are soldered to the relevant terminal pads 9, respectively.

Thereafter, the assembly of the two units 1A, 2A is detached from the chuck device to be mounted on the heat sink 4 (see FIG. 1 for example). Finally, the connector 10 is attached to the bottom surface of the substrate 2 of the signal relay unit 2A.

According to the present invention, the signal relay unit 2A and many other identical units may be collectively obtained in the following manner.

Figure 6A:
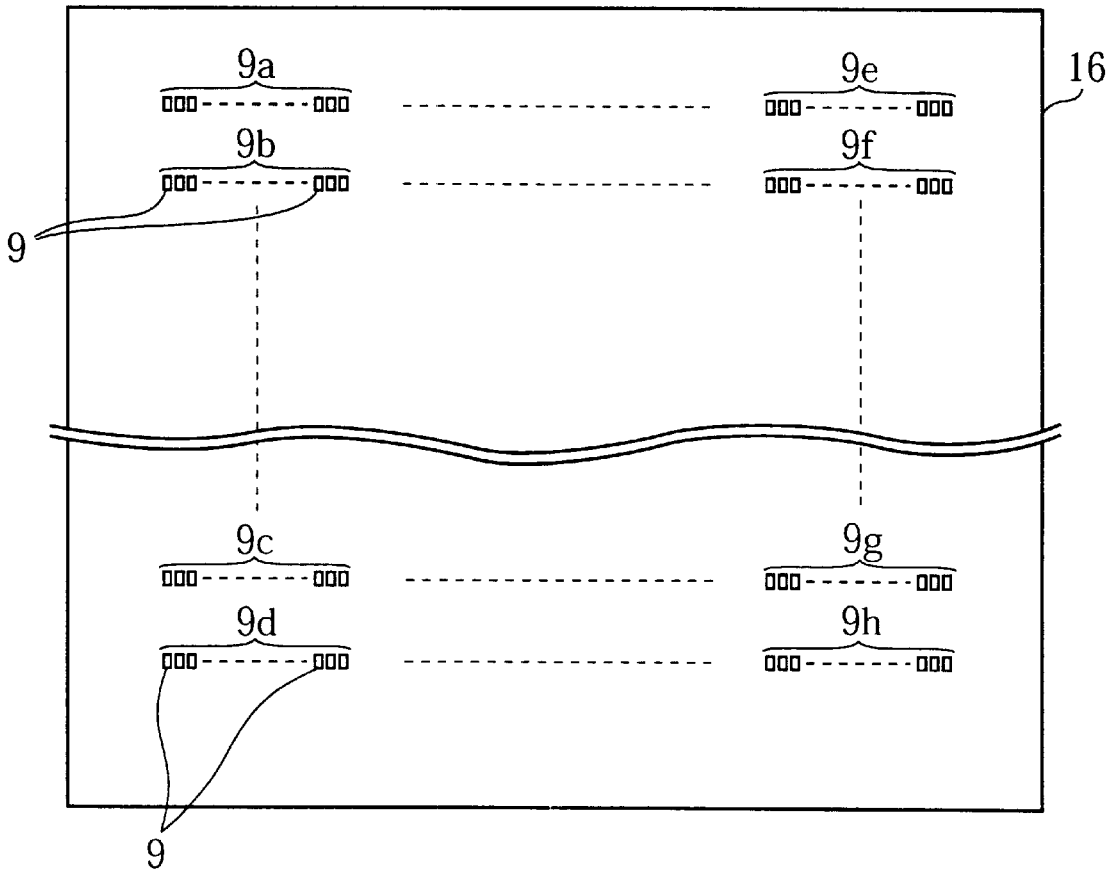
FIGS. 6A–6C illustrate how the signal relay unit of the above thermal printhead is obtained from a mother board.

First, referring to FIG. 6A, a mother board 16 made of GFR epoxy resin is prepared. The mother board 16 is large enough to provide a predetermined number of rectangular substrates identical to the auxiliary substrate 2 shown in FIGS. 1–3. The mother board 16 is provided, on its obverse and reverse surfaces, with predetermined wiring patterns (not shown) which may be formed by photolithography. Together with these wiring patterns, a plurality of rows of terminal pads 9 are also formed on the obverse surface of the mother board 16. In FIG. 6A, only eight rows 9*a*–9*h* of terminal pads are depicted for convenience of illustration.

Figure 6B:
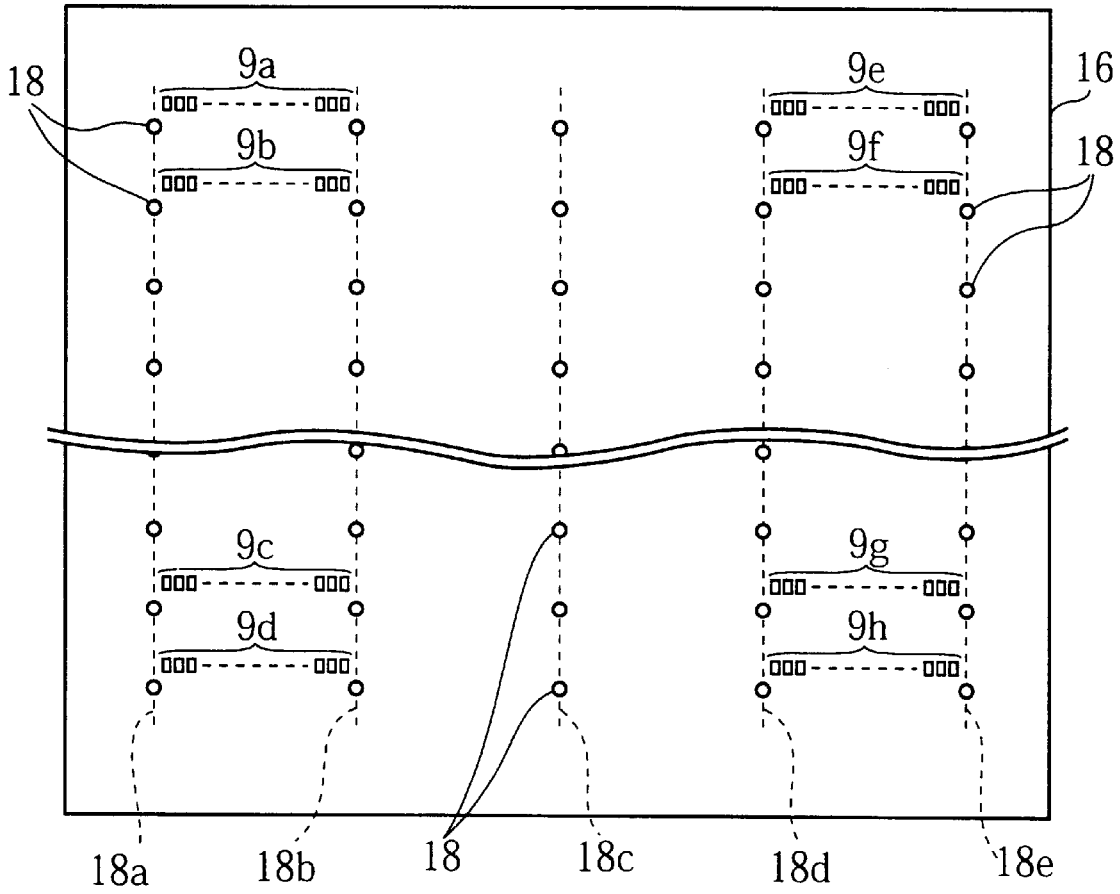

Then, as shown in FIG. 6B, a plurality of through-holes 18 are bored in the mother board 16 by drilling for example. As illustrated, the through-holes 18 are arranged in a plurality of columns (five columns 18*a*–18*e* are shown). These columns are equally spaced from each other. In each column, the through-holes 18 are arranged at regular intervals.

The above-described through-holes 18 are formed after the locations of the non-illustrated wiring patterns and terminal pads 9 are detected by an optical sensing device (not shown). The detected locations of these elements are used as reference data for determining where to bore the through-holes 18 in the mother board 16. In this manner, the through-holes 18 are to be formed at the desired locations relative to the terminal pads 9 and the non-illustrated wiring patterns.

Figure 6C:
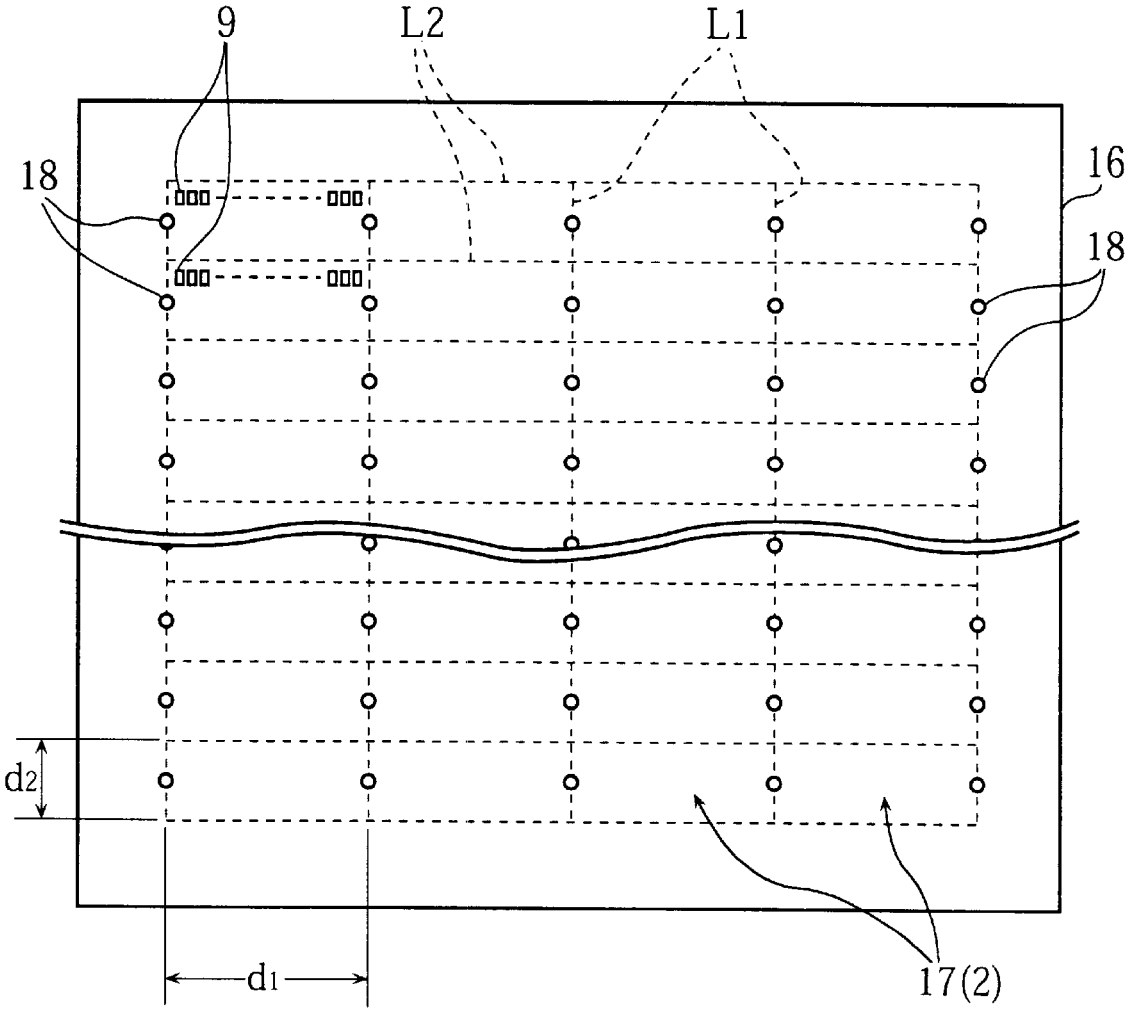

Finally, referring to FIG. 6C, the mother board 16 is cut along cut lines L1 and cut lines L2 perpendicular to the cut lines L1. Preferably, the cutting may be first performed along the cut lines L1, and then along the cut lines L2. The cutting may be performed using a cutting blade.

As illustrated in FIG. 6C, the cut lines L1 and L2 define a plurality of rectangular regions 17, which correspond to the auxiliary substrate 2 and other identical substrates. Each cut line L1 extends through the center of the relevant through-holes 18 arranged in a column. The distance between the adjacent cut lines L1 is d1, while the distance between the adjacent cut lines L2 is d2. The distance d1 is equal to the length L shown in FIG. 3, while the width W1 is equal to the width W1 shown in the same figure.

In the above manner, advantageously, a plurality of rectangular substrates identical to the auxiliary substrate 2 shown in FIGS. 1–3 are collectively obtained from a single mother board.

Though not illustrated in FIG. 6B, different kinds of through-holes other than the through-holes 18 may be collectively formed in the mother board 18. These additional through-holes may be used for connecting the wiring pattern on the obverse surface of the mother board to the wiring pattern on the reverse surface of the mother board. The collective forming of the through-holes 18 and the additional through-holes is advantageous to improving the production efficiency since no additional step is required for forming the non-illustrated additional through-holes.

Differing from the process shown in FIGS. 6A–6C, the rectangular regions 17 defined by the cut lines L1 and L2 may be determined before the terminal pads 9, the non-illustrated wiring pattern and the through-holes 18 are formed. After such regions 17 are determined, the terminal pads 9, the non-illustrated wiring pattern and the through-holes 18 are formed, in each region 17, with reference to the locations of the cut lines L1 and L2. In this case, the center of each through-hole 18 should be located on the relevant one of the cut lines L1, as shown in FIG. 6C.

The heating resistor unit 1A shown in FIGS. 1–3 and many other identical units may also be collectively obtained from a single mother board in the following manner. First, a rectangular mother board (not shown) made of alumina ceramic is prepared. Then, the mother board is subjected to photolithography to form predetermined wiring patterns on its obverse and reverse surfaces. As in the mother board 16 shown in FIG. 6C, a plurality of regions are defined in the alumina ceramic mother board by a predetermined number of cut lines. Each of these identical regions is formed with the same wiring pattern.

Then, an elongated heating resistor may be formed in each of the above-mentioned regions of the mother board. Specifically, resistive paste is applied in each rectangular region by screen-printing, and then the applied paste is baked. Thus, the respective rectangular regions of the mother board are provided with a heating resistor.

Then, a protection coat may be formed on the mother board for covering the heating resistors and the wiring patterns.

Then, the mother board is divided along the predetermined cut lines to separate one rectangular region from another.

Then, required electronic components such as drive ICs are mounted on each separated region, while wire-bonding is performed for e.g. connecting the drive ICs to the wiring pattern on each separated region. A plurality of connection terminals (reference numeral 8 in FIG. 2) are formed a longitudinal edge of each separated region.

Finally, a resin coating made of e.g. epoxy resin may be formed on each separated region to cover the drive ICs and the bonding-wires. Thus, heating resistor units as shown in FIGS. 1–3 (reference numeral 1A) are obtained.

Figure 7:
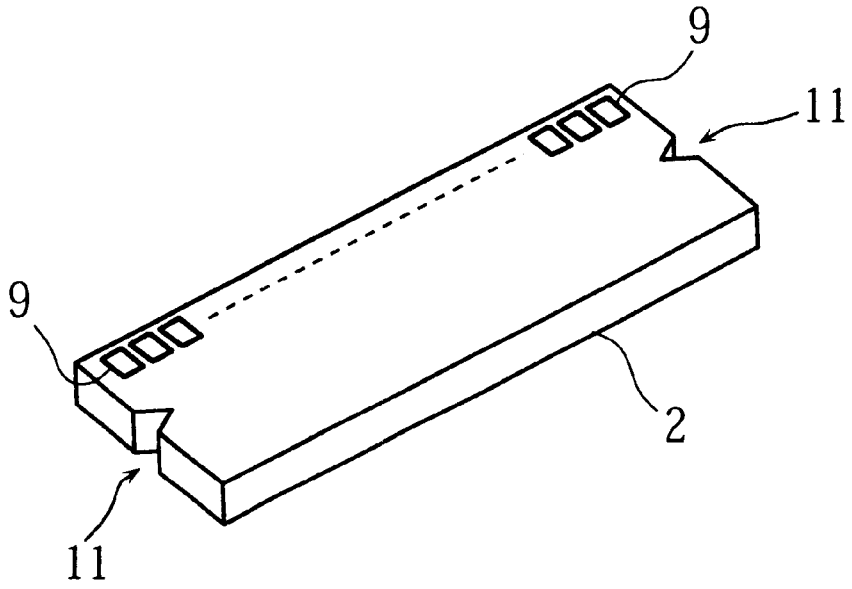
FIGS. 7 and 8 show a different example of positioning grooves and pins used for positioning the signal relay unit.
Figure 8:
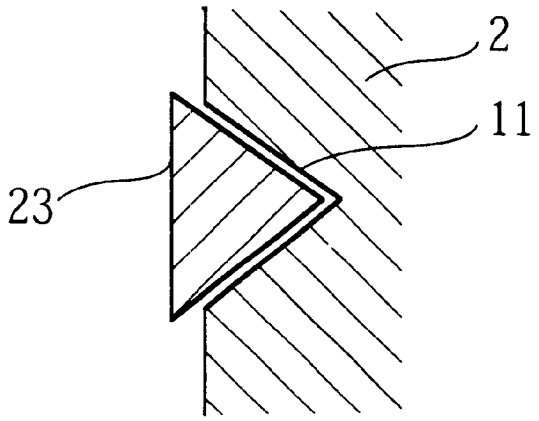
Figure 9:
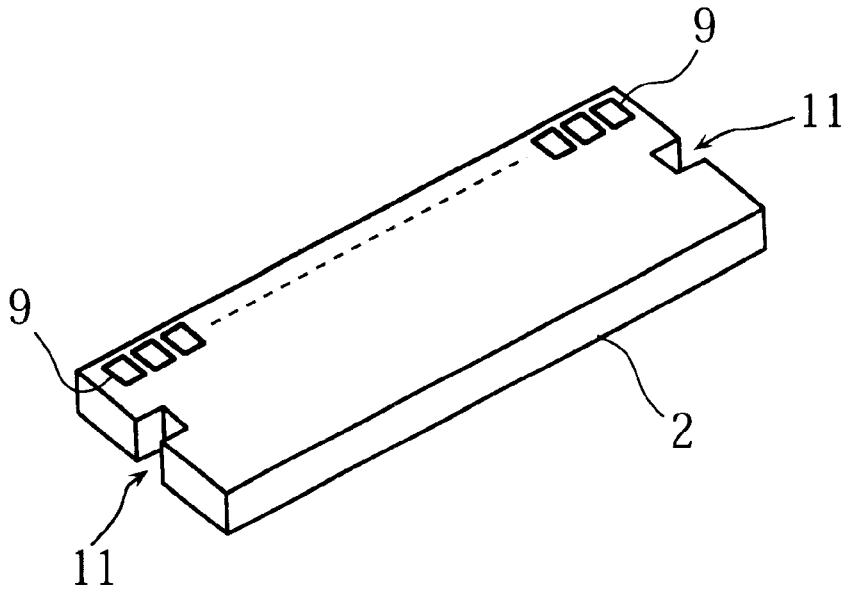
FIGS. 9 and 10 show another example of positioning grooves and pins used for positioning the signal relay unit.
Figure 10:
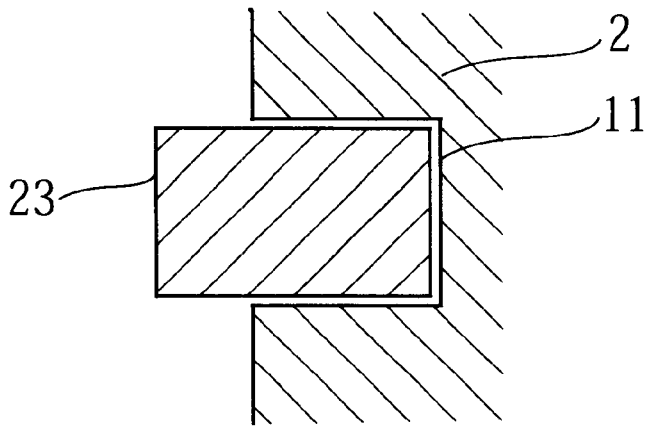
Figure 11:
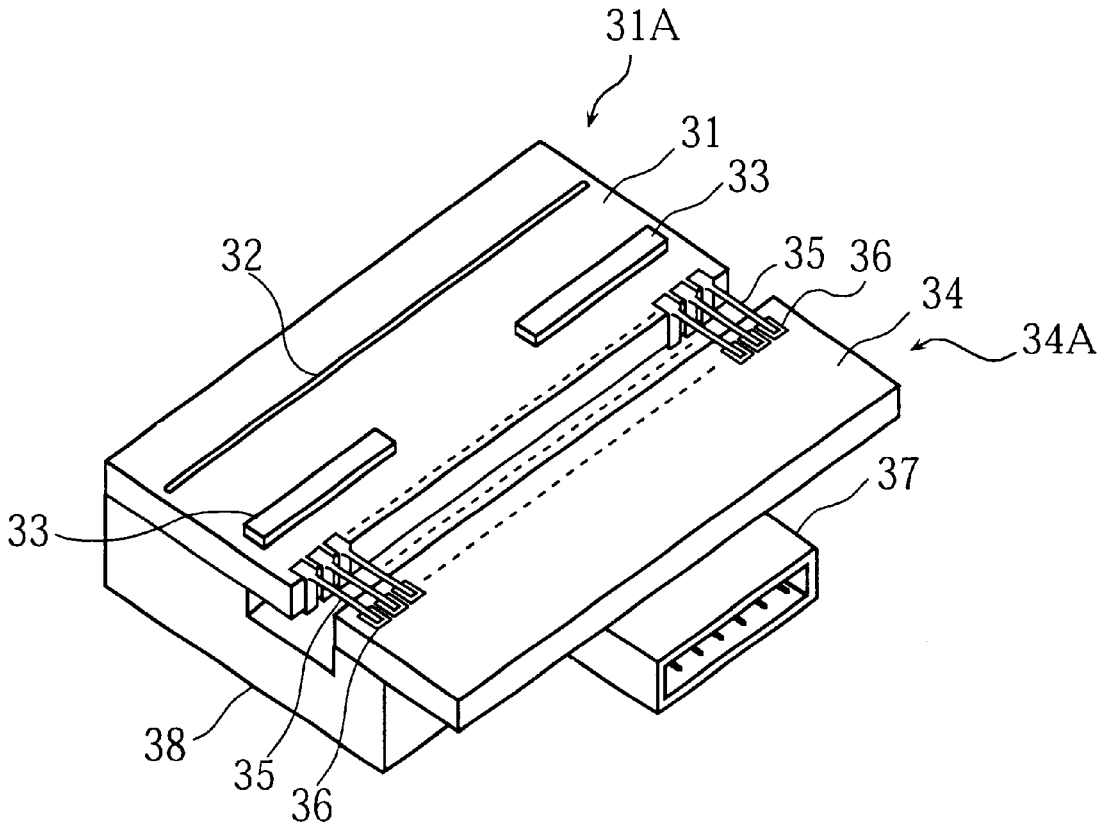
FIG.11 RELATED ART
FIG. 11 is a perspective view showing an example of thermal printhead for better understanding of the present invention.
Figure 12:
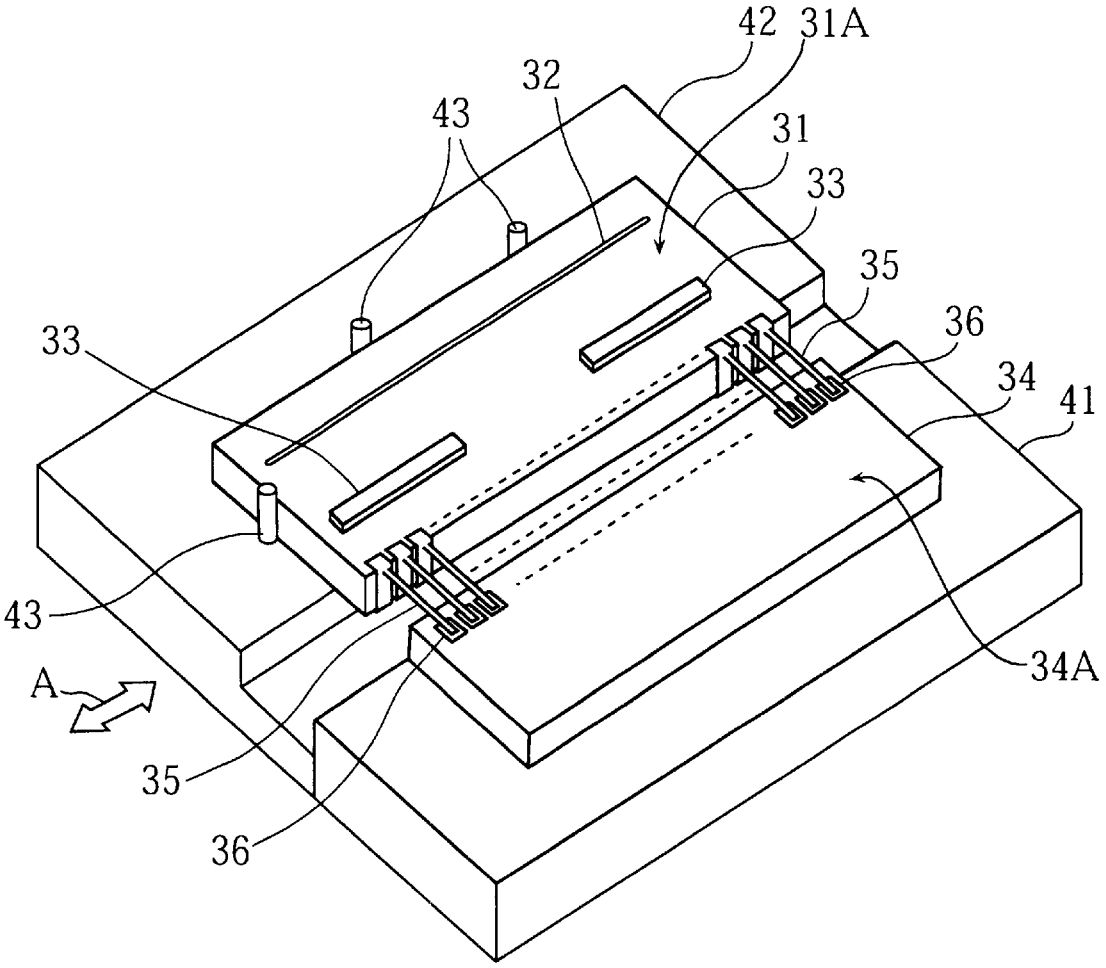
FIG.12 RELATED ART
FIGS. 12 and 13 illustrate a step for fabricating the thermal printhead of FIG. 11.
Figure 13:
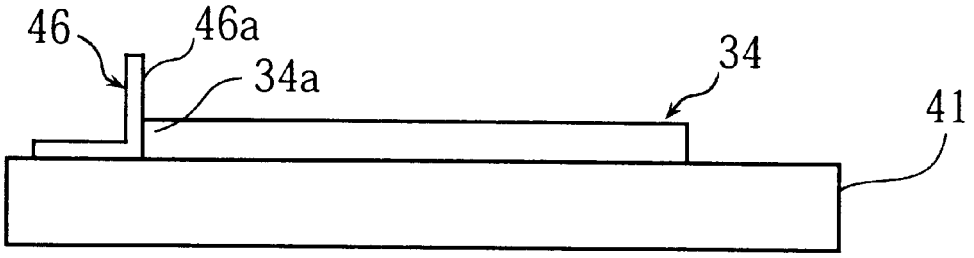
FIG.13 RELATED ART
Figure 14:
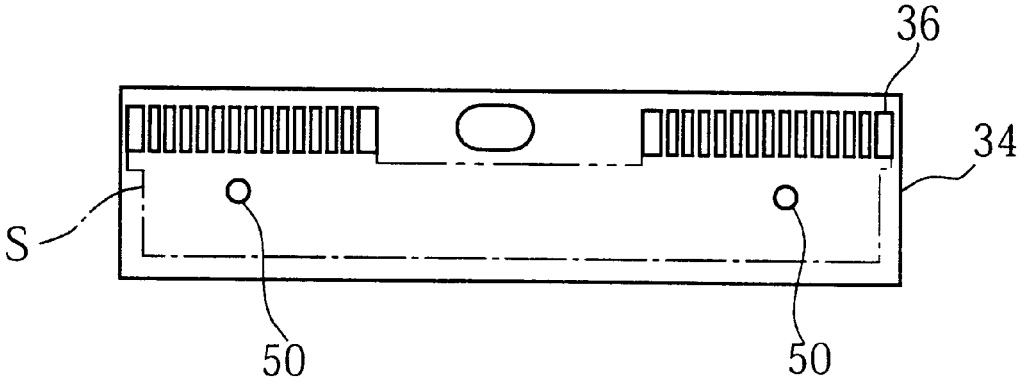
FIG.14 RELATED ART
FIG. 14 is a plan view showing another example of thermal printhead for better understanding of the present invention.

Thereafter, a predetermined number of clip pins 3 are clipped onto each of the heating resistor units The present invention is not limited to the above-described examples. For instance, each of the positioning grooves 11 of the substrate 2 may have a triangular cross section, as shown in FIGS. 7 and 8. In this case, the positioning pins 23 may also have a triangular cross section. Further, the positioning grooves 11 and the positioning pins 23 may have a rectangular cross section, as shown in FIGS. 9 and 10.

According to the present invention, the positioning grooves 11 may be arranged at the longitudinal edges of the substrate 2 other than at the illustrated shorter edges. The number of the positioning grooves 11 (and hence the positioning pins 23) may be larger than two.

In the illustrated preferred embodiment of the present invention, the grooves 11 and pins 23 are provided for positioning the signal relay unit 2A to the first chuck member 21 (FIGS. 4 and 5). However, the same kind of positioning means may be used for positioning the heating resistor unit 1A to the second chuck member 22.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A method of making a thermal printhead including first and second substrates spaced from each other, the method comprising the steps of:

forming at least one positioning cutout at an edge of the first substrate;

mounting the first substrate onto a first position adjusting chuck member provided with a positioning pin to be fitted into the positioning cutout;

positioning the first and the second substrates relative to each other; and establishing electrical connection between the first and second substrates.

2. The method according to claim 1, wherein the positioning cutout comprises a semi-cylindrical groove.

3. The method according to claim 1, wherein the positioning cutout has a triangular cross section.

4. The method according to claim 1, wherein the first substrate is formed with two positioning cutouts each of which is arranged at an edge of the first substrate.

5. The method according to claim 4, wherein the first substrate is provided with two longer edges and two shorter edges, the two positioning cutouts being arranged at the shorter edges.

6. The method according to claim 1, wherein the electrical connection is established via linear conductive members bridging between the first and the second substrates.

7. The method according to claim 1, further comprising the step of mounting the second substrate onto a second position adjusting chuck member, wherein the relative positioning of the first and the second substrates is performed by moving the first and the second position adjusting chuck members relative to each other.

8. A thermal printhead comprising:

a first substrate provided with a heating resistor;

a second substrate associated with the first substrate; and connecting means bridging between the first and the second substrates;

wherein at least one positioning cutout is formed at an edge of at least one of the first and the second substrates for facilitating positional adjustment of the first substrate relative to the second substrate.

9. The thermal printhead according to claim 8, wherein the position cutout comprises a semi-cylindrical groove.

10. The thermal printhead according to claim 8, further comprising a supporting member upon which the first and the second substrates are mounted, the supporting member being arranged to avoid overlapping with the positioning cutout.

11. The thermal printhead according to claim 10, wherein the supporting member comprises a heat sink.

12. The thermal printhead according to claim 10, wherein the positioning cutout is unengaged with any portion of the supporting member.

* * * * *